United States Patent [19]

Parquet

[11] 4,164,119

[45] Aug. 14, 1979

[54] HYDRAULIC PUMP UNLOADING SYSTEM

[75] Inventor: Donald J. Parquet, Burlington, Iowa

[73] Assignee: J. I. Case Company, Racine, Wis.

[21] Appl. No.: 890,037

[22] Filed: Mar. 27, 1978

[51] Int. Cl.[2] ..... F15B 13/09

[52] U.S. Cl. ..... 60/428; 60/430; 60/486

[58] Field of Search ..... 60/428, 429, 430, 486

[56] References Cited

U.S. PATENT DOCUMENTS

| | | | |
|---|---|---|---|
| 2,618,932 | 11/1952 | Taup | 60/430 |
| 3,540,218 | 11/1970 | Finn | 60/428 X |
| 3,822,551 | 7/1974 | Smith | 60/428 |

*Primary Examiner*—Edgar W. Geoghegan
*Attorney, Agent, or Firm*—Arthur J. Hansmann

[57] ABSTRACT

A hydraulic pump unloading system having an engine driving two hydraulic pumps which are connected in parallel to a load-supporting member. An unloading valve is connected in the hydraulic line with one of the two pumps and is shiftable between positions for directing flow to the load and for directing flow to a reservoir, depending upon the pressure and or flow in the hydraulic line. Also, a pressure-compensated flow-control valve is connected in the line with the other pump and, under certain conditions, directs fluid pressure to the unloading valve for setting the unloading valve in either the operative or the unloading position, all depending upon the hydraulic condition at the load-supporting member. Further, either an additional valve or a spring can be effective on the unloading valve for controlling the operative and the unloading position of the unloading valve. The system is arranged so that when the workload approaches an excessive magnitude, one of the pumps is unloaded so that the engine will not stall.

9 Claims, 3 Drawing Figures

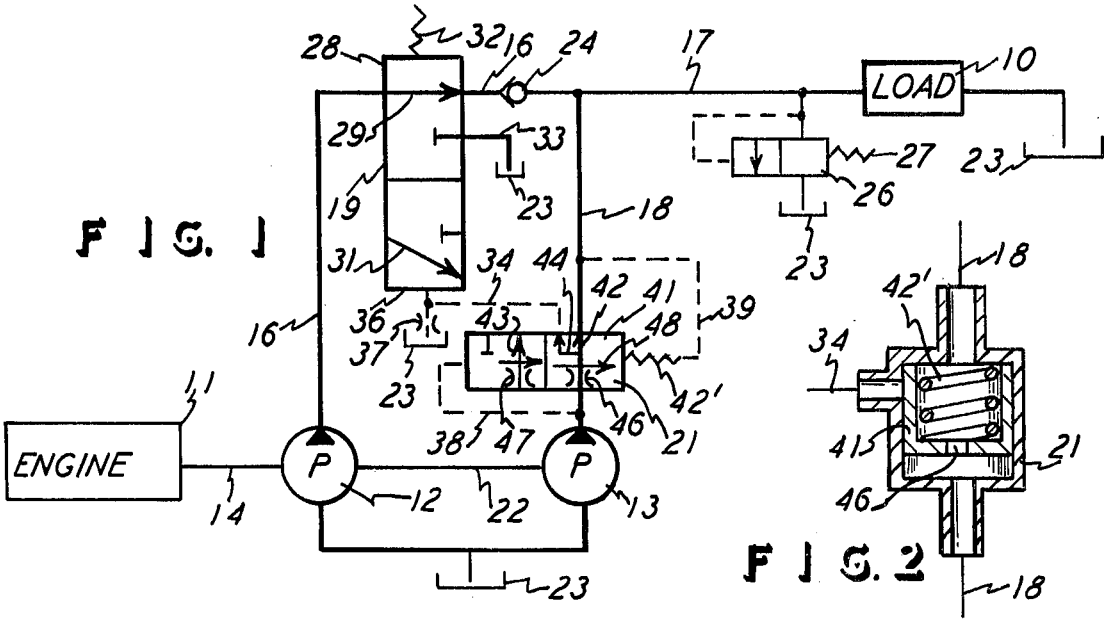
FIG. 1
FIG. 2
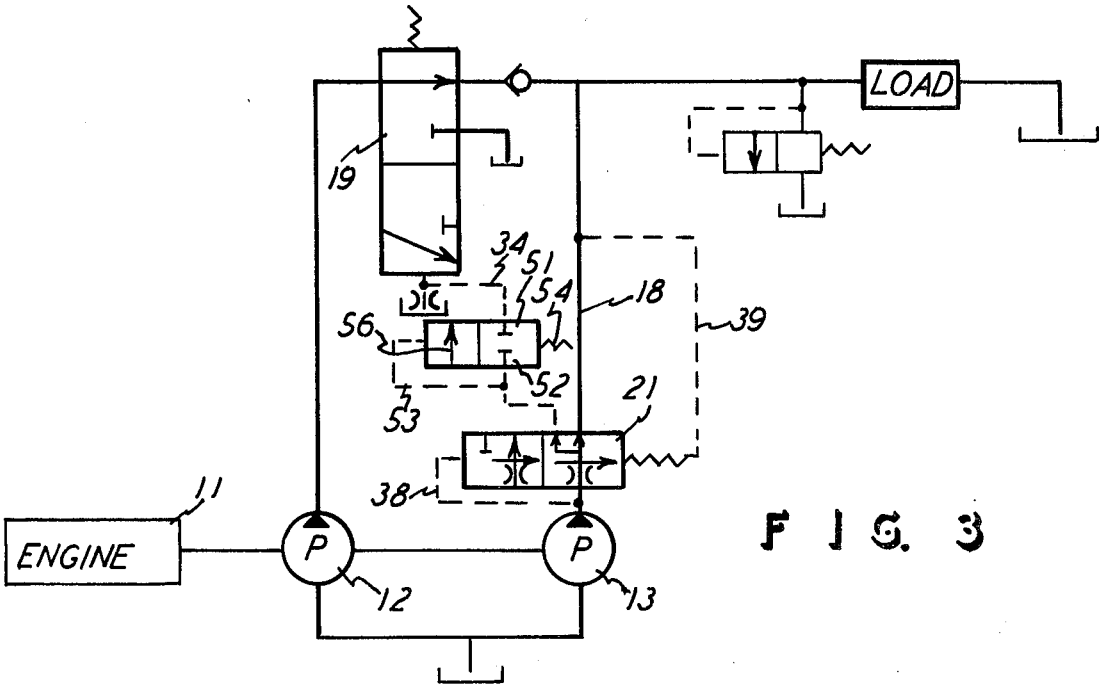
FIG. 3

HYDRAULIC PUMP UNLOADING SYSTEM

This invention relates to a hydraulic pump unloading system, and, more particularly, it relates to a system wherein there are two hydraulic pumps driven by an engine, and one of the pumps can be unloaded or placed in an inoperative position when the load reaches a certain magnitude, all for avoiding stalling of the driving engine.

BACKGROUND OF THE INVENTION

The prior art, and anyone skilled in the art, is already aware of hydraulic systems of various arrangements of hydraulic pumps and driving engines and valves for directing hydraulic-flow to a load-supporting member, such as a hydraulic cylinder or a hydraulic motor or the like. In previously known hydraulic systems, the hydraulic pump or pumps are employed for working upon the workload in whatever manner rquired, and the driving engine is relied upon for producing sufficient power to drive the pumps to support whatever load the system may be designed to support. However, it is common knowledge that the systems can be overloaded to an extent that the engine can no longer drive the pumps, and thus the engine will falter and even stall, and then the entire tractor, vehicle, or whatever system is employed, will become completely inoperative.

The present invention provides an arrangement for avoiding the aforementioned problem of stalling the driving engine. In accomplishing this objective, the present invention provides a hydraulic system wherein one of two or more hydraulic pumps can be unloaded, depending upon the condition of the hydraulic pressure and flow in the system, that is, depending upon the force exerted by the system to support and move a workload. Still further, the present invention accomplishes the unloading in an automatic manner, that is without requiring manual control of valves, and the system is also arranged so that it automatically becomes reset and self-operating when the hydraulic condition within the system regains its normal condition subsequent to one of the pumps being automatically unloaded, as mentioned.

Still further, the aforementioned objectives are also accomplished in conditions where the hydraulic fluid is cold, and thus the aforementioned objectives are accomplished for a cold-start type of condition and therefore one of two or more pumps is automatically unloaded and retained unloaded until the hydraulic fluid reaches an effective working temperature.

Still further, the hydraulic system of this invention accomplishes the aforementioned objectives in a system which is designed and arranged according to the stall speed of the engine. That is, the load which is supported by the system is related to the power producible by the engine so that when the maximum load is exceeded, the system will automatically unload itself and avoid stalling the driving engine. Additionally, the entire hydraulic system is not unloaded at the point just prior to engine stall speed, but only a part of the system is unloaded, to avoid engine stall, but another part of the system remains effective and operative to support the workload or to perform its work.

Still further, it is an object of this invention to provide a hydraulic pump or automatic unloading system which is both hydraulic speed and hydraulic pressure sensitive for effecting the automatic unloading of a part of the hydraulic drive system, while leaving the remainder of the hydraulic drive system operative for supporting a workload.

Other objects and advantages will become apparent upon reading the following description in light of the accompanying drawings.

BRIEF DESCRIPTION OF THE DRAWINGS

FIG. 1 is a hydraulic schematic view of an embodiment of this invention.

FIG. 2 is an enlarged sectional view of one of the valves employable in FIG. 1.

FIG. 3 is a hydraulic schematic view of the embodiment shown in FIG. 1 with a valve added thereto.

DETAILED DESCRIPTION OF THE PREFERRED EMBODIMENT

The drawings show, and the invention relates to, a hydraulic system which can be employed in a tractor or like power vehicle for supporting a workload by means of a load-supporting member which is generally designated 10. Thus, the system is arranged for supporting a load through a hydraulic work-supporting or load-supporting member 10 which is hydraulically connected in the system which also includes the driving engine 11 and two hydraulic pumps 12 and 13 which are conventionally drivingly connected with the engine 10, such as through the drive transmission member indicated by line 14. Therefore, it will be seen and understood by anyone skilled in the art that there is a drive engine 11 mechanically drivingly connected with the hydraulic pumps 12 and 13 which in turn are hydraulically connected with the load-supporting member 10 for performing the work desired.

Thus, there is a hydraulic line 16 extending from the pump 12 and connecting to a line 17 which in turn is connected to the load-supporting member 10. Also, the pump 13 is hydraulically connected with the line 17 by means of a hydraulic line 18. It will be further seen and understood that there is a hydraulic unloading valve 19 in the line 16 and there is a hydraulic pressure-compensated flow control valve 21 in the line 18. Still further, it will be seen and understood that the pumps 12 and 13 are in a parallel connection so that both are driven by the engine 11, and there is shown a drive connection 22 between the pumps 12 and 13 for schematically indicating the powering of the pumps 12 and 13 by means of the engine 11. Also, in the usual schematic manner understandable by anyone skilled in the art, the system has a reservoir indicated 23 so that the pumps 12 and 13 can receive a hydraulic supply and so that the load-supporting member 10 can evacuate its used fluid into the reservoir 23, all in the usual arrangement and manner understood by anyone skilled in the art.

The system also employs a hydraulic check-valve 24 which precludes the flow of fluid in the direction from the load and to the unloading valve 19, while permitting the flow of fluid from the valve 19 and to the load. There is also a pressure relief valve 26 which has a relief spring 27 for holding the valve 26 in the closed position until sufficient pressure develops in the system and to thereby permit that pressure to be relieved to the reservoir 23 when the valve 26 shifts to the right, as viewed in FIGS. 1 and 3, all in the usual arrangement.

The unloading valve 19 has a shiftable member 28 carrying two fluid passageways 29 and 31 which respectively fluid-flow communicate with the hydraulic line 16, depending upon the up and down shifted position of the shiftable member 28, as viewed in FIGS. 1 and 3. A compression spring 32 yieldingly urges the shiftable member 28 to the downward position shown in FIGS. 1 and 3. Thus, as shown in FIGS. 1 and 3, the flow goes through the line 16 and to the line 17. However, when the shiftable member 28 is shifted to an upward position, then the passageway 31 will flow-communicate with the incoming portion of line 16 and will direct flow to a hydraulic line 33 which leads to the reservoir 23 and thus the valve 19 dumps or unloads the fluid and does not direct it into the loadline 17 for supporting the load.

In addition to the spring 32, the shiftable member 28 is positioned by fluid pressure in a sensing hydraulic line 34 interconnected between the valves 19 and 21 so that fluid pressure is directed to the end 36 of the shiftable member 28, and that end is of course opposite from the compression spring 32, thus with sufficient pressure in the sensing hydraulic line 34, the force of the spring 32 will be overcome and the shiftable member 28 will move upwardly to flow-communicate the fluid passageway 31 with the line 16 and with the line 33, all for the unloading condition described above. In this arrangement, there is a flow restrictor 37 between the line 34 and the reservoir 23, and thus the pressure in the line 34 is mainly directed to the shiftable member 28 and is only permitted to seep to the reservoir 23, all so that the fluid pressure in the line 34 will be adequately directed against the shiftable member 28 for upwardly shifting thereof, as mentioned. In this arrangement, there must therefore be at least a minimum pressure in the line 34 to cause the upward shifting of the member 28, and the calibration or strength of the spring 32 is critical in the system and can be arranged so that only when a minimum hydraulic condition exists in the line 34 will there be an overcoming of the force in the spring 32 to cause the upward shifting of the member 28, and this point will be described again herein-after.

Valve 21 has hydraulic lines 38 and 39 fluid-flow connected to opposite sides of the valve 21, and the lines 38 and 39 are also connected with the line 18 on the respective upstream and downstream sides of the valve 21. Further, the valve 21 has a shiftable member 41, and that member is under the influence of a compression spring 42' which of course urges the member 41 to the leftward position shown in FIGS. 1 and 3. The shiftable member 41 has two fluid passageways 42 and 43, both of which are interconnectable with the line 18 to direct flow through the valve 21 and along the line 18. Further, it will be seen that the valve 21 has a third passageway 44 which fluid-flow connects with the line 34 through the valve 21 and thus off the line 18, such as shown in the position in FIGS. 1 and 3. Still further, the valve 21 has fluid-flow restrictors 46 and 47 which are disposed effective on the respective fluid passageways 42 and 43 for effecting different hydraulic conditions between the upstream and downstream sides of the valve 21, all according to which passageway 42 or 43 is in fluid-flow communication with the line 18.

FIG. 2 shows a sectional view of one physical embodiment of a pressure compensated flow controlled valve 21, and here it will be seen that the line 18 and line 34 are shown related to the valve 21, and the shiftable member 41 and the spring 42' are also shown, and the flow restrictor 46 is shown. As such, a drawing of an actual valve 21 is shown in FIG. 2 and will be understood by one skilled in the art.

In the operation of the system, the engine 11 is driving both pumps 12 and 13 in the initial condition. In the event that the hydraulic fluid is cold and thus viscous and presents resistance, or in the event that the load becomes excessive for the system, a hydraulic static condition will exist on the flow-opposite sides of the valve 21, and this condition will of course be presented in the hydraulic lines 38 and 39 to the opposite sides of the shiftable member 41 which is therefore hydraulically force-balanced and only the spring 42' is left to be effective on the shiftable member 41 which is thus shifted to the leftward position shown in the FIGS. 1 and 3. In that position, hydraulic pressure is presented to the line 34 and consequently to the shiftable member 28 which is therefore shifted upwardly to where the passageway 31 aligns with the hydraulic line 16 to cause the unloading of the fluid pressure in the line 16 and thus relieve the engine of creating fluid pressure in the pump 12. That is, the pump 12 is unloaded by means of the shifting of the unloading valve 19, and that leaves only the pump 13 to operate the system and the engine will not stall.

The drawings further show that the valve 21 is controllable, such as indicated by the arrows 48 extending across the passageways 42 and 43, and thus the amount of flow through the valve 21 can be manually controlled.

Next, when the hydraulic flow to the pump 13 is above the engine stall speed equivalent, the valve 21 shifts to the right, as viewed in FIGS. 1 and 3, and thus the passageway 43 fluid flow connects with the line 18 and there is then no possibility of shifting the valve 19 to its unloading position. Accordingly, both pumps 12 and 13 are fully operative for working upon the load, as then desired. However, when the pumps' speed and thus hydraulic flow decrease, the engine 11 will be under greater load and tend toward stalling. Shortly before engine stall speed is reached, pump 13 is not delivering enough flow to hold valve 21 against the spring 42' since the pressure in the line 38 is not great enough to hold shiftable member 41 against the spring 42', and of course the line 39 is then connected with the line 18 downstream from the flow restrictor 47, at that time. Therefore, valve 21 will shift to the left and to the position shown in FIGS. 1 and 3 and the hydraulic pressure will then be presented to the unloading valve 19 for unloading the pump 12, all as desired to thus avoid stalling of the engine 11.

Likewise, if the speed of the engine 11 has been manually set below what is a safe minimum regarding the stall speed, only the pump 13 will be operating relative to supporting the load, and again the engine will not be stalled when the load is applied to the system. In this explanation, the system is responsive to the speed of flow of hydraulic fluid through the system.

Additionally, the system is also responsive to the hydraulic pressure therein, and that is accomplished under the condition where the pressure in line 18 is sufficiently great to be substantially the same on the incoming and outgoing sides of valve 21 and thus the pressure is balanced on opposite ends of the shiftable member 41 and the spring 42' again causes the member 41 to shift to the left to the position shown in FIGS. 1 and 3. This could be a combined low speed and high pressure condition tending to cause engine stall. Therefore, the pressure again will be sensed in the line 34 and will cause the unloading valve 19 to shift upwardly to unload the pump 12, as desired. In that arrangement, the strength of the spring 32 is critical and related to the force created on the shiftable member 28 by the hydraulic pressure in the line 34. That is, the strength of the spring 32 will be of a minimum magnitude to permit the member 28 to shift only when the spring 32 is overcome by the hydraulic pressure presented in the line 34, and thus the unloading of the pump 12 is achieved only when a maximum magnitude of load is applied to the system and thus it protects engine stalling at a load above the maximum load.

FIG. 3 shows the inclusion of a pressure sensitive valve 51 connected in the line 34 and thus interconnected between the valves 19 and 21. The valve 51 has a shiftable member 52, and there is a pilot or pressure sensing line 53 connected with the line 34 and extending to one end of the shiftable member 52, and a compression spring 54 urges the member 52 to the leftward position shown in FIG. 3. Of course when hydraulic pressure is sufficiently high in the lines 34 and 53, then the member 52 is shifted to the right, as viewed in FIG. 3, and its fluid passageway 56 will then align and connect with the line 34 to pass the fluid pressure to the unloading valve 19 which will then shift upwardly to the unloading position previously described. In that arrangement, the pressure sensitive valve 51 is responsive to the pressure of the hydraulic fluid in the system and it can be utilized in place of the calibration and criticality of the spring 32 utilized as described above.

In conclusion, the hydraulic system is responsive to both the speed of hydraulic flow and the pressure of the fluid in the system, and the system is also responsive to the magnitude of the load and to the temperature of the hydraulic fluid, and thus all four conditions mentioned determine the unloading of the pump 12 in the system.

What is claimed is:

1. A hydraulic pump unloading system comprising a hydraulic reservoir, two hydraulic pumps, a power source connected with said pump for driving said pumps, a driven load-supporting member, hydraulic lines connected between said pumps and said load-supporting member for directing hydraulic fluid to said load-supporting member and including two hydraulic lines connected directly to respective ones of said pumps, a hydraulic unloading valve hydraulically connected with said hydraulic line which is connected to one of said two pumps, said unloading valve having a shiftable member with two fluid passageways and with one of said passageways being in fluid-flow communication with the respective said hydraulic line connected with said one pump, an additional hydraulic line connected with said unloading valve and leading to said reservoir and with the other of said two fluid passageways being fluid-flow communicable with said additional hydraulic line upon shifting of said shiftable member for relieving hydraulic pressure and workload relative to said one pump, an additional hydraulic valve hydraulically connected in said hydraulic line which is connected to the other of said two pumps, said additional hydraulic valve having a shiftable member with two fluid passageways and with one of the latter said two passageways being in fluid-flow communication with the respective said hydraulic line connected with the other said pump, an additional hydraulic line connected between said valves and being fluid-flow communicable with said other passageway of said additional valve when said additional valve shiftable member is shifted for directing fluid pressure to said shiftable member of said unloading valve to thereby shift the latter said shiftable member and unload the fluid pressure in said hydraulic line connected with said one pump, and an additional line interconnected between said other pump and said additional hydraulic valve and being in fluid-flow communication with said shiftable member in said additional valve for shifting the latter said shiftable member according to the fluid condition in said hydraulic line connected between said other pump and said load-supporting member.

2. The hydraulic pump unloading system as claimed in claim 1, wherein said unloading valve includes a spring for urging its said shiftable member to the position of flow communicating its said one passageway with said hydraulic line connected with said one pump.

3. The hydraulic pump unloading system as claimed in claim 2, wherein said shiftable members are fluid-pressure responsive members, said spring is of a minimum strength sufficient to yield, in urging said unloading valve shiftable member to the position of flow-communicating its said one passageway with said hydraulic line connected with said one pump, in response to and accordance with fluid force in said additional hydraulic line between said valves and acting on said shiftable member of said unloading valve.

4. The hydraulic pump unloading system as claimed in claim 1, wherein said additional valve includes a spring for urging its said shiftable member to the position of flow communicating its said one passageway with said hydraulic line connected with said other pump.

5. The hydraulic pump unloading system as claimed in claim 2, wherein said unloading valve shiftable member is exposed to fluid pressure at one end of its shifted position to thereby be shifted by fluid pressure in the system, a spring acting on said unloading valve shiftable member for urging the latter toward the one end of its shifted position, and a fluid pressure responsive valve connected in said additional hydraulic line between said valves and having a shiftable member with a fluid passageway flow-communicable with the latter said additional hydraulic line and being shifted to the latter stated position in response to fluid force in the latter said additional hydraulic line.

6. The hydraulic pump unloading system as claimed in any of claims 1, 2, 3, 4, or 5, including a flow restrictor in fluid-flow communication with said hydraulic line connected between said other pump and said additional hydraulic valve and at a location downstream from the interconnection between said other pump and its said additional hydraulic line, and relative to the fluid pressure output of said other pump, for creating both fluid flow differential and fluid pressure differential between the upstream and downstream sides of said other pump.

7. A hydraulic pump unloading system comprising a hydraulic reservoir, two hydraulic pumps, a power source connected with said pumps for driving said pumps, a driven load-supporting member, hydraulic lines connected with said pumps and said load-supporting member for fluid-flow communication from said pumps to said load-supporting member, a valve means connected in fluid-flow communication in each of said hydraulic lines, a fluid pressure responsive movable flow diverter means in one of said valve means for the flow of fluid through the respective said hydraulic line in one operative position of said flow diverter means and for diverting the flow of fluid from the latter said hydraulic line in another operative position of said flow diverter means, an additional hydraulic line fluid-flow connected between said one of said valve means and said reservoir for receiving the flow diverted by the latter said valve means and thereby diverting that flow to said reservoir, an additional hydraulic line connected between the two said valve means, and a fluid pressure responsive movable flow diverter means in the other of said valve means for diverting the flow to the latter said additional hydraulic line for fluid pressure actuating said one of said valve means.

8. The hydraulic unloading system as claimed in claim 7, wherein said one valve means includes spring means for urging its said diverter means to the position of flow communicating with its said hydraulic line connected with said load-supporting member.

9. The hydraulic unloading system as claimed in any of claims 7 or 8, including a flow restrictor in fluid-flow communication with said hydraulic line connected between one of said pumps and said other valve means and at a location upstream from the interconnection between said other valve means and said additional hydraulic line, for creating both fluid flow differential and fluid pressure differential between the upstream and downstream sides of said other valve means.

* * * * *